US005352106A

United States Patent [19]

Lenk et al.

[11] Patent Number: 5,352,106

[45] Date of Patent: Oct. 4, 1994

[54] APPARATUS FOR MELT SPINNING MULTICOMPONENT YARNS

[75] Inventors: Erich Lenk, Remscheid; Ralph Sievering, Wermelskirchen; Gerd Zimmerbeutel, Huckeswagen; Gerhard Nickisch, Radevormwald, all of Fed. Rep. of Germany

[73] Assignee: Barmag AG, Remscheid, Fed. Rep. of Germany

[21] Appl. No.: 926,763

[22] Filed: Aug. 6, 1992

[30] Foreign Application Priority Data

Aug. 6, 1991 [DE] Fed. Rep. of Germany ..... 4125956

[51] Int. Cl.[5] ..... B29C 47/30; D01D 5/32

[52] U.S. Cl. ..... 425/131.5; 425/133.1; 425/192 S; 425/463; 425/DIG. 217

[58] Field of Search ..... 425/131.5, 133.1, DIG. 207, 425/192 S, 183, 463; 264/171

[56] References Cited

U.S. PATENT DOCUMENTS

| | | | |
|---|---|---|---|
| 3,320,633 | 5/1967 | Cancio et al. | 425/DIG. 217 |
| 3,375,548 | 4/1968 | Kido et al. | 425/DIG. 217 |
| 3,526,019 | 5/1970 | Matsui et al. | 425/131.5 |
| 3,559,237 | 2/1971 | Biggelaar et al. | 425/131.5 |
| 3,601,846 | 8/1971 | Hudnall | 425/131.5 |
| 3,669,591 | 6/1972 | Fermi et al. | 425/131.5 |
| 3,963,406 | 6/1976 | Reker | 425/131.5 |
| 4,052,146 | 10/1977 | Sternberg | 425/131.5 |
| 4,645,444 | 2/1987 | Lenk et al. | 425/192 S |
| 4,696,633 | 9/1987 | Lenk et al. | 425/192 S |
| 4,698,008 | 10/1987 | Lenk et al. | 425/192 S |
| 4,738,607 | 4/1988 | Nakajima et al. | 425/DIG. 227 |
| 4,875,844 | 10/1989 | Nakajima et al. | 425/131.5 |
| 5,035,595 | 7/1991 | Nakajima et al. | 425/131.5 |

FOREIGN PATENT DOCUMENTS

| | | | |
|---|---|---|---|
| 0122464 | 11/1988 | European Pat. Off. . | |
| 4114064 | 11/1991 | Fed. Rep. of Germany . | |
| 43-5165 | 2/1968 | Japan | 425/131.5 |

*Primary Examiner*—Khanh Nguyen
*Attorney, Agent, or Firm*—Bell, Seltzer, Park & Gibson

[57] ABSTRACT

A spinning apparatus for melt spinning thermoplastic multicomponent yarn is disclosed, in which a nozzle pack (22) is joined by bolts with a filter cup (13), with the entire unit being mounted by a thread (21) on a connecting plug (20) of the pump or distributor block (10). The nozzle pack (22) is adapted to produce bicomponent yarns, and the exchange of a single blending plate (37) allows the apparatus to produce different structures of bicomponent filaments. Such spinning apparatus enhance the flexibility of the synthetic fiber producer and reduce the cost for spare parts, since it is necessary to keep available only additional blending plates (37), but not entire nozzle packs (22).

13 Claims, 4 Drawing Sheets

APPARATUS FOR MELT SPINNING MULTICOMPONENT YARNS

BACKGROUND OF THE INVENTION

The present invention relates to a spinning apparatus for melt spinning multicomponent yarns, and which has the ability to produce different structures of multicomponent yarns.

Spinning apparatus are known in various designs which have a separate passage for the individual components for producing different kinds of multicomponent yarns. Such known spinning apparatus are complicated in their constructional design and therefore very costly. Due to the different channel arrangement for the individual components with regard to the desired kind of the bicomponent yarns, they are neither exchangeable nor can they be retrofitted with simple means. It is therefore necessary to perform very carefully the assembly, operation, cleaning and mounting of the nozzle packs. It is further necessary to entrust highly skilled operating personnel with the assembly of the nozzle packs and their startup.

It is an object of the present invention to provide a spinning apparatus for multicomponent filaments of the type comprising a spinning plate having nozzle bores extending therethrough which are connected with melt lines of the several components, and wherein the exchange of individual structural parts permits the spinning program to be changed in a simple manner.

It is further the object of the present invention to provide for a spinning apparatus which distinguishes itself in the different possibilities of its use in the production of bicomponent filaments and by favorable manufacturing and warehousing costs.

SUMMARY OF THE INVENTION

The above and other objects and advantages of the present invention are achieved in the embodiment illustrated herein by the provision of a melt spinning apparatus which comprises a heater box having a vertically extending open shaft. A spinning head means is closely received in the upper portion of the vertically extending shaft for extruding at least two different thermoplastic components through respective discharge outlet means, and a collection chamber is positioned in the shaft below each of the discharge outlet means for receiving and collecting respective ones of the components. A spinning nozzle plate is mounted in the shaft below the collection chambers and includes a plurality of nozzle bores extending vertically therethrough. A blending plate is mounted in the shaft between the collection chambers and the nozzle plate. The blending plate includes at least two melt lines leading to and communicating with each of the nozzle bores, with a distribution channel means connecting each of the collection chambers with respective ones of the melt lines leading to each nozzle bore, so that the melt lines leading to each nozzle bore are adapted to deliver different components to such nozzle bore.

The arrangement of the spinning apparatus between a collection chamber for each component and the common spinning nozzle plate permits nozzle packs for different products to be designed, and which comprise substantially identical subassemblies. This simplifies the expenditure for the manufacture by increasing the batch sizes and reducing the costs for storing spare parts and furnishing tools. At the user end, considerable advantages result from lesser investment cost with the same number of spinning positions and an increase in flexibility in the manufacture of different products.

A further advantage of the invention resides in the fact that the components from which the filaments are spun are filtered in separate filter chambers which are located in a common filter cup, before they are supplied to the different nozzle bores. As a result, the service life increases until a change of the nozzle pack is required as a result of contamination. In a preferred embodiment, the filter cup is adapted to be threadedly connected to a connecting plug fixed at the base of a melt distributor block, with the connecting plug including a melt line for each component. The interior of each filter chamber is sealed against the connecting plug by a differential piston which is axially movable in the filter chamber. This construction results in the advantage of a compact subassembly comprising the nozzle pack and melt filtration, which can be mounted with simple means on the melt distributor block, and in which the melt flows of the individual components are advantageously sealed against one another and against the melt supply lines.

A further advantage of the present invention relates to the possibilities of configuring the distributor plate, the blending plate and the nozzle plate of the spin pack, so as to realize particularly favorably the advantages connected with the invention.

The melt lines in the blending plate may be differently configured so as to spin bicomponent yarns in a side-by-side configuration on the one hand, or yarns having a core-sheath configuration on the other. In so doing, it is only necessary to exchange the blending plate with the same setup of the nozzle pack for another with a modified channel arrangement, so as to be able to utilize the different options of the various spinning programs.

It should be noted that the foregoing description of the construction of the nozzle pack is not limited to the production of filament yarns of only two components and to the mentioned structures, but it also applies in a corresponding manner to multi-component filaments of more than two components and modified structures. Further, it is not necessary that the components be thermoplastic melts. Thus, the invention also comprises elastomeric components and components in dissolved condition, even though the use of thermoplastic melts of polyamides, polyesters or polyolefins is preferred in melt spinning.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENT

Figure 1:
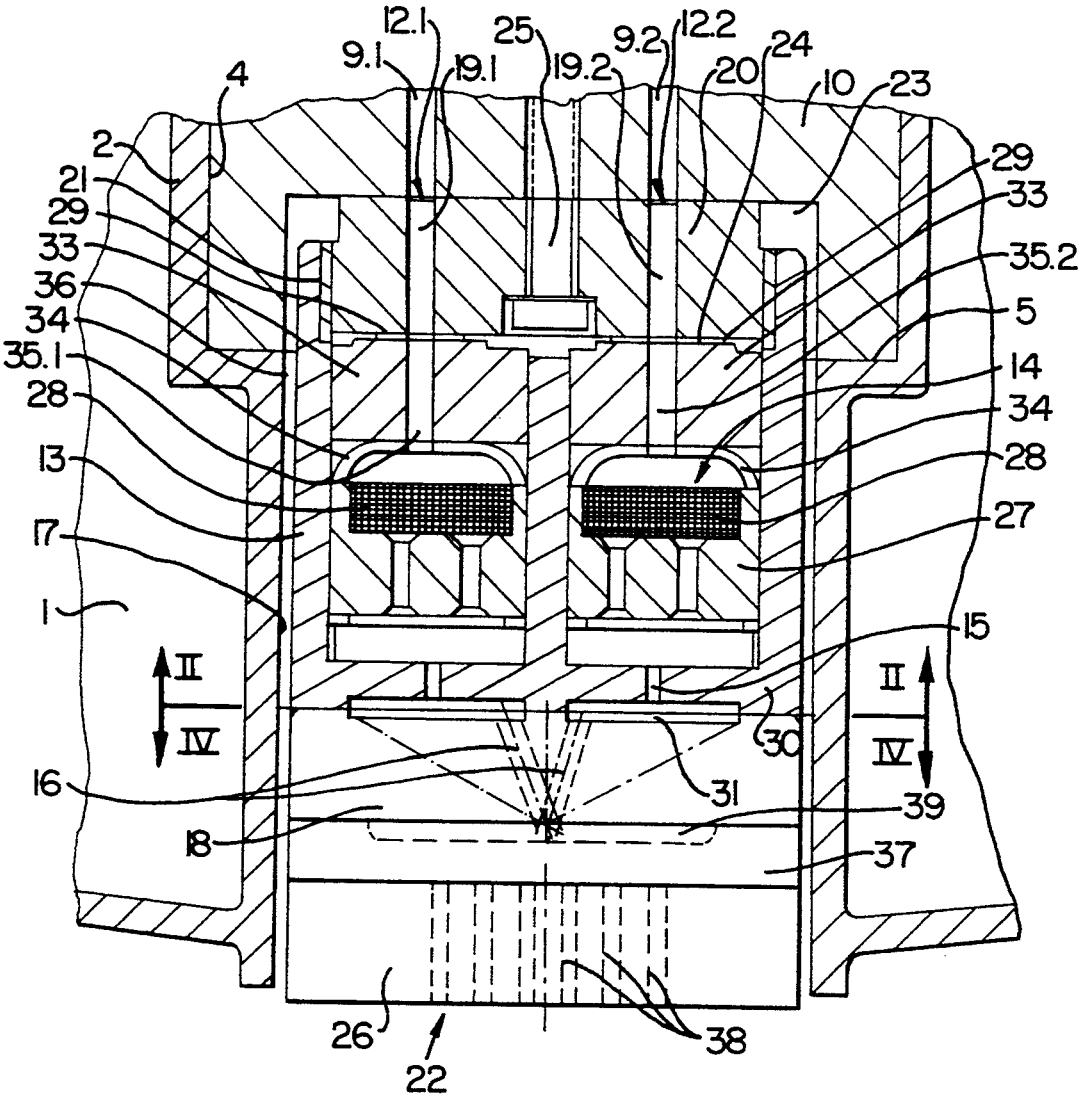
FIG. 1 is a cross sectional view of a spinning apparatus in accordance with the invention.
Figure 2:
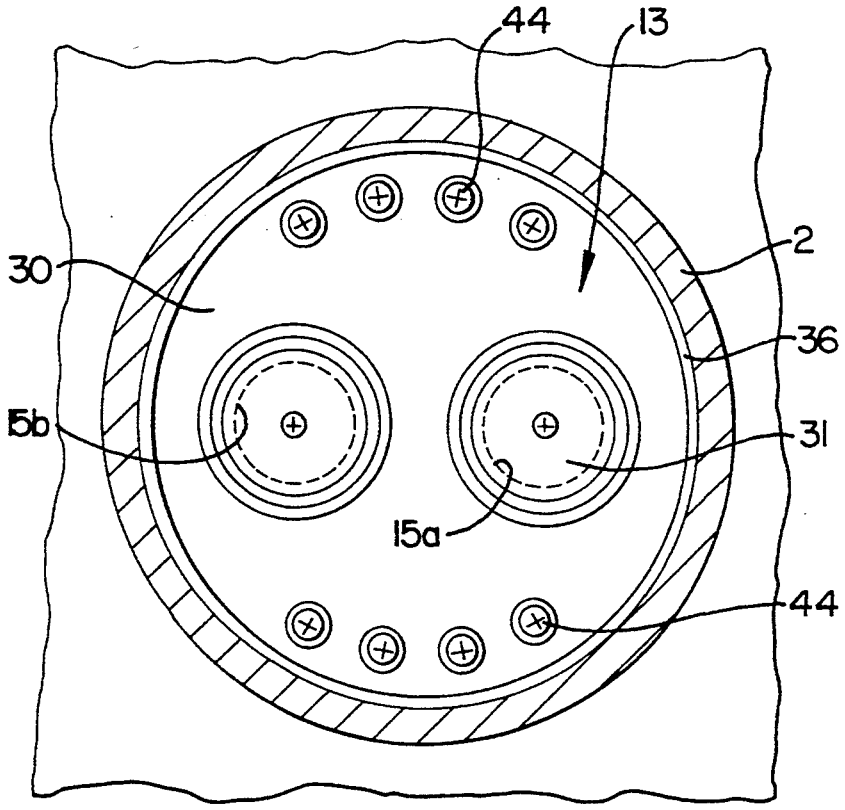
FIG. 2 is a sectional view of the spinning apparatus taken along line II—II of FIG. 1.

Referring more particularly to the drawings, FIG. 1 illustrates a melt spinning apparatus which includes a heater box 2. The heater box 2 has hollow walls and is provided with heating chambers 1, which are hermetically closed and filled with a heating medium, for example, with a fluid, heat transferring oil.

The spinning apparatus comprises two spin pumps (not shown) which are attached to a pump block 10. The pump block 10 and the pumps are enclosed in heater box 2. The spin pumps are supplied by the spin extruder with molten polymers and deliver the melt flows evenly metered into melt ducts 9.1 and 9.2 of pump block 10. Between pump block 10 and a filter cup 13, it is also possible to arrange a further distributor block which serves as an intermediate component and contains only melt lines. The illustrated block 10 may be such a distributor block, or the pump block itself, and it rests on a step 5 of the jacket surrounding the heater box 2, thereby closely contacting the heat transfer surfaces 4 of the heating jacket. At step 5, the heater box 2 is open vertically downward and forms a circular nozzle shaft 17. On its underside, the pump block 10 has a connecting surface with two outlet ends 12.1 and 12.2 of the melt ducts 9.1 and 9.2. The outlet ends 12.1 and 12.2 are at a distance from one another which corresponds substantially to the distance of the centers of filter chambers 14 in filter cup 13.

Arranged on the underside of the pump block 10 is a connecting plug 20. A mounting screw 25 secures the plug 20 to the block 10, however, as an alternative, the connecting plug 20 may be designed as a downward extending projection of the pump block 10 with an external thread. In the illustration, the connecting plug 20 is arranged concentrically in a circular recess 23 of the block 10. On its outer circumference, the connecting plug 20 is provided with a thread 21 which leaves so much space toward the circular recess 23 of the pump block or the distributor block 10 that it is still possible to screw the filter cup 13 onto this thread 21. To this end, the filter cup 13 is provided with an internal thread on its upper open end. The filter cup 13 is a cylindrical body which fits into the nozzle shaft 17 of the heater box 2 leaving only a small air gap 36, and which fills the nozzle shaft 17 together with the nozzle pack 22 in the axial direction.

In its interior, the filter cup 13 has two cylindrical bores which form two cylindrical filter chambers 14. The filter chambers 14 are aligned parallel to the axis of the filter cup 13, and each receive a filter unit.

In the illustrated embodiment, each filter unit comprises the following parts: The filter cup 13 is provided with two filter chambers 14, and has in its bottom 30 one or several discharge holes 15 which terminate in a circular collection chamber. In each filter chamber 14 a support ring (not indicated in detail) and a filter support plate 27 overlie the cup bottom 30. On its upstream side, the plate 27 has a cylindrical recess, which accommodates a filter pack 28, for example, of wire screens having a graded number of meshes, quartz sand of a defined grain size, or the like. The plate 27 is arranged for sliding movement in the respective filter chamber 14 and rests on its support ring.

Located above filter pack 28 is the filter chamber which is closed by a self-sealing seal 34 in the form of a diaphragm and closed by an overlying differential piston 33. The differential piston 33 is arranged for sliding movement in filter chamber 14, and it contains a passageway 35 which is located approximately centrically in the piston 33. On the side facing away from filter pack 28, the passageway 35 of piston 33 is surrounded by a seal 29. On the side facing the filter pack 28, the passageway 35 also extends through the self-sealing diaphragm 34.

The operation of the filter units is as follows: once installed in the filter cup 13, the differential pistons 33 rest with their seals 29 on the underside 24 of the connecting plug 20. When now the filter packs 28 receive the melt under pressure, a high pressure builds up in the filter chambers 14. Due to this pressure, the self-sealing diaphragms 34 come to lie in the circumferential corners formed between the filter chambers 14 and the differential pistons 33 and seal same. The differential pistons 33 are pushed upward, which leads simultaneously to a sealing in the region of seals 29, since the differential pistons 33 are biased on their entire downstream side by the melt pressure, whereas on their upstream side they are only biased by the melt pressure operative on the cross sectional surface of the passageways 35.

Figure 3:
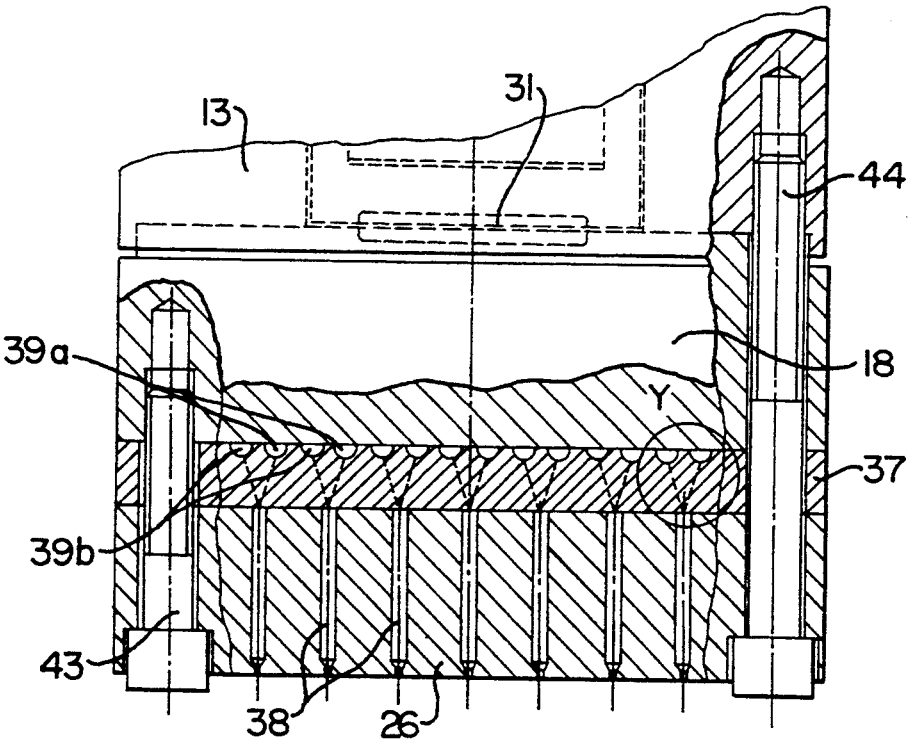
FIG. 3 is a sectional view of the nozzle pack downstream of the filter cup.
Figure 4:
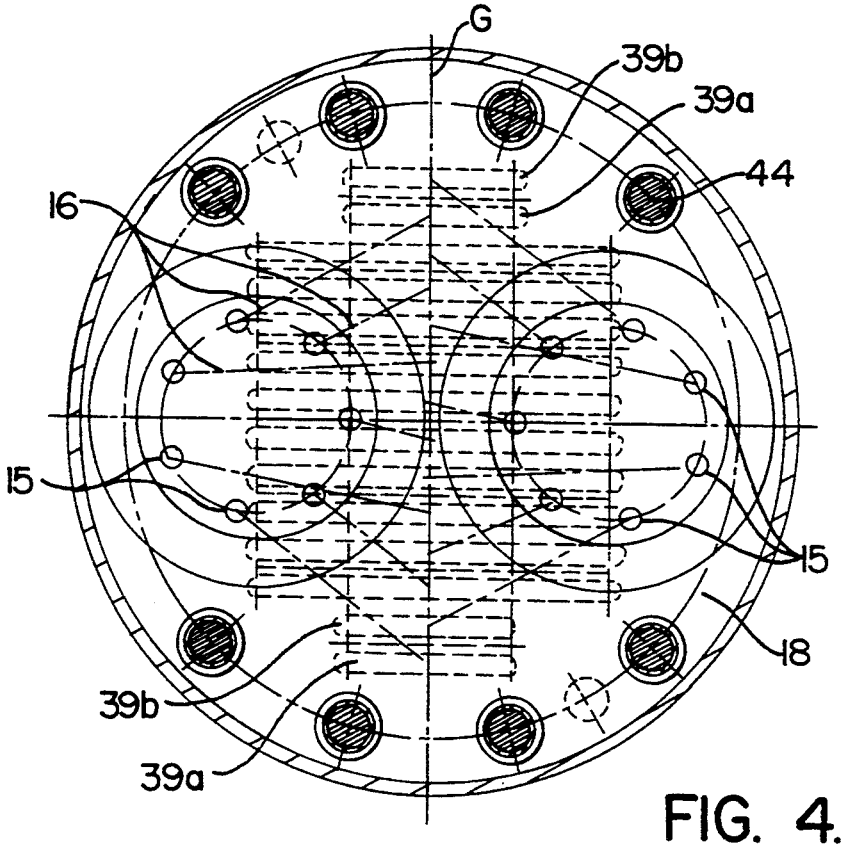
FIG. 4 is a sectional view of a slightly modified spinning apparatus taken along line IV—IV of FIG. 1.

A nozzle pack 22, as shown in FIG. 1 in side view and in FIGS. 3 and 4 in cross sectional view and top view respectively, is mounted to the bottom wall 30 of the filter cup 13 by bolts 44. The nozzle pack 22 comprises, when viewed in the flow direction of the polymers, a distributor plate 18, a blending plate 37, and a spin nozzle plate 26 containing nozzle bores 38. These three plates are preassembled and joined with one another by bolts 43 distributed over the circumference.

Arranged in distributor plate 18 on its upstream side, as seen in FIGS. 3 and 4, are, for example two cross sectionally circular collection chambers 31, which are substantially identical in diameter and radial arrangement with the collection chambers formed at the bottom of filter cup 13. Proceeding from the collection chambers 31, melt ducts 16 extend obliquely through the distributor plate 18. They all terminate on the downstream side of plate 18 along a straight line G, a first melt duct 16 which is connected with the one collection chamber 31 for a first melt component, alternating with a second melt duct 16 which is connected with the collection chamber 31 for a second melt component. In FIG. 4, the melt ducts 16 and their arrangement in distributor plate 18 are shown in dash-dot lines.

Provided in the upper side of the underlying blending plate 37 are parallel longitudinal channels or grooves 39 in such a manner that the longitudinal grooves extend substantially perpendicular to the straight line G, on which the melt ducts 16 terminate in distributor plate 18. The separation of the longitudinal grooves 39 corresponds to the separation of the melt ducts 16 terminating in distributor plate 18. As a result of this, it is accomplished that the juxtaposed longitudinal grooves **39*a*, 39*b*** alternate in receiving the component delivered by the melt pumps.

Figure 5:
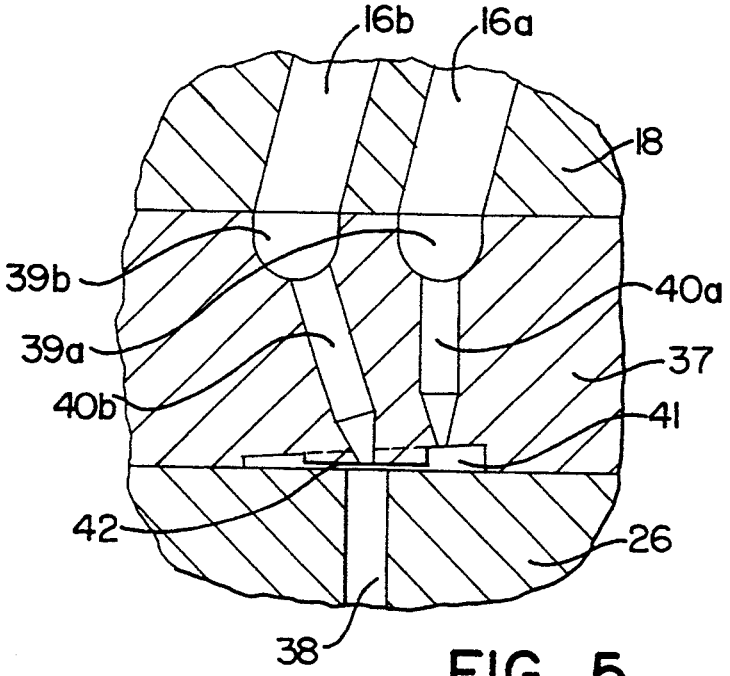
FIG. 5 is a fragmentary view of the melt lines in the blending plate for a core-sheath configuration.
Figure 6:
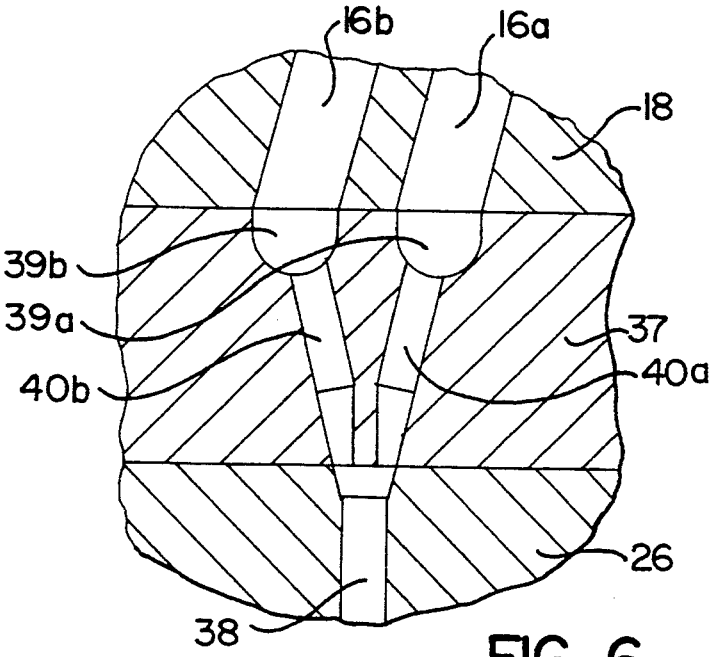
FIG. 6 is a fragmentary view corresponding to FIG. 5, but with the melt lines configured for filaments with a side-by-side configuration.

Proceeding from longitudinal grooves **39*a*, 39*b*, melt lines 40*a*, 40*b* are provided in the blending plate 37, for example in an arrangement as shown in FIG. 5 or in FIG. 6. These arrangements are selected in accordance with the desired structure of the bicomponent yarns. As shown in FIG. 5, the melt line 40*b* extends from longitudinal groove 39*b* axially through the blending plate 37, and terminates above the center of a nozzle bore 38. A second melt line 40*a* which proceeds from the neighboring longitudinal groove 39***a*, extends substantially parallel to melt line 4O*b*, and terminates in an annular duct 41 with a cross section dimensioned such that a uniform distribution occurs all around the centric melt line 40*b* via a narrow annular slot 42. Such an arrangement of melt lines 40*a*, 40*b* in blending plate 37 produces core-sheath filaments having a substantially centric core component.

In the arrangement of lines 40*a*, 40*b* in blending plate 37, as shown in FIG. 6, the melt lines 40*a*, 40*b* proceed likewise from neighboring longitudinal grooves 39*a*, 39*b* in the upper side of blending plate 37, and extend then substantially parallel side-by-side, axially through the blending plate 37. They terminate side-by-side on the underside of the blending plate likewise in a point predetermined by the pattern of nozzle bores 38 in nozzle plate 26, or in a common choke bore located in the end side of blending plate 37 above the nozzle bore 38. With the use of a blending plate 37 having a line arrangement in accordance with FIG. 6, filaments with a side-by-side structure are obtained.

Finally, the downstream end of nozzle pack 22 is formed by the nozzle plate 26, in which nozzle bores 38 are arranged in a predetermined pattern. On the inlet end, they have a widened, or if need be, a cross section formed as choke bore, and narrow on the outlet end to the actual spin nozzle cross section of the capillary holes. The pattern of the bore centers is formed by the intersections of two groups of straight lines crossing each other. They may be located at the corners of identical parallelograms, rectangles or diamonds. In the illustrated embodiment, they are located in the corner of rectangles. This is best seen in FIG. 4, wherein one of the two groups of lines is illustrated as dashed lines which are parallel to and between the grooves 39*a*, 39*b*, and the other of the two groups of lines is illustrated as solid lines which are perpendicular to the lines of the first group.

To operate the spinning apparatus, the nozzle plate 26, the distributor plate 18 and the selected blending plate 37 are assembled to form the nozzle pack 22 by means of bolts 43 distributed over the circumference. The latter is then joined with filter cup 13 by means of longer bolts 44. The seals, cleaned filter groups, differential pistons 33 and seals 29 overlying the latter are now inserted into filter cup 13. The entire unit is finally threaded on the thread 21 of connecting plug 20, thereby effecting a preliminary sealing. The final sealing of the filter and nozzle packs proceeds as described above, automatically as a result of the melt pressure in filter chambers 14, when the spinning position is started up.

The advantage of the described spinning apparatus for bicomponent yarns consists in particular in that it allows to spin a plurality of different yarn structures with a single spinning system. In so doing, the apparatus remains substantially unchanged, except blending plate 37 with the melt lines 40 arranged therein, which contains the desired option of the setup of the bicomponent filaments, and which needs to be exchanged at a change of the spinning program.

It should further be noted that naturally it is also possible to arrange the melt lines 40 in blending plate 37 in such a manner that, for example the core component A is eccentric to the sheath component B, or is present in a lesser ratio than 50 to 50 percent. In the case of side-by-side structures it is likewise advantageously possible to influence by constructional measures, if need arises, the portions of the components in the composite filaments, their arrangement in the filament cross section and to the crosswise impacting flow of cooling air. Thus, it becomes possible with a suitable channel arrangement in blending plate 37 to also produce other structures of bicomponent yarns, for example, in a segmental structure with alternately succeeding components A, B, A, B (side-by-side or circumferential arrangement) in the filament yarn, or in core-matrix structures (islands-in-the-sea).

Finally, mention should be made that a corresponding configuration of the blending plate 37 also allows to obtain a so-called "black-white" spinning. In this process, the melt channels 39*a*, 39*b* for the different polymers arranged parallel in the melt inlet side of blending plate 37 are each supplied to the nozzle bores 38 in nozzle plate 26 such that the polymers are not combined and/or blended. Rather, the filament yarns of component A and such of component B are spun, which after their cooling and solidification below the nozzle plate are combined to a multifilament yarn and jointly further treated, drawn, and wound, and preferably subjected to a textile aftertreatment.

In the drawings and specification, there has been set forth a preferred embodiment of the invention, and although specific terms are employed, they are used in a generic and descriptive sense only and not for purposes of limitation.

That which is claimed is:

1. A melt spinning apparatus adapted for spinning multi component yarn and comprising a heater box having a vertically extending open shaft, spinning head means closely received in the upper portion of said vertically extending shaft for extruding at least two different thermoplastic components through respective discharge outlet means, a collection chamber positioned in said shaft below each of said discharge outlet means for receiving and collecting respective ones of said components, a spinning nozzle plate mounted in said shaft below said collection chambers and including a plurality of nozzle bores extending vertically therethrough, a blending plate mounted in said shaft between said collection chambers and said nozzle plate, said blending plate including at least two melt lines leading to and communicating with each of said nozzle bores, a distributor plate positioned in said shaft between said collection chambers and said blending plate, and so as to form an interface with said blending plate, a plurality of parallel longitudinal channels formed at the interface between said distributor plate and said blending plate, with alternate ones of said channels respectively communicating with one of said melt lines leading to each of said nozzle bores and with intervening ones of said channels respectively communicating with a second one of said melt lines leading to each of said nozzle bores, and distribution channel means formed in said distributor plate and connecting one of said collection chambers with alternate ones of said channels, and connecting the other of said collection chambers with intervening ones of said channels, so that said melt lines leading to each nozzle bore are adapted to deliver different components to such nozzle bore, and with said distribution channel means including a plurality of melt ducts which terminate at said interface along a straight line which is perpendicular to the longitudinal direction of said channels.

2. The melt spinning apparatus as defined in claim 1 wherein said nozzle bores have inlets which are arranged in a predetermined pattern, and wherein said melt lines in said blending plate have outlets which are arranged in a pattern which corresponds to said predetermined pattern.

3. The melt spinning apparatus as defined in claim 2 wherein said nozzle bores are arranged in parallel straight lines, and wherein said parallel channels are arranged parallel to and above said parallel straight lines.

4. The melt spinning apparatus as defined in claim 1 wherein said nozzle plate and said blending plate are releasably connected to said spinning head means so as to render the blending plate readily exchangeable.

5. The melt spinning apparatus as defined in claim wherein said melt lines in said blending plate which extend to a common nozzle bore are disposed in a side by side arrangement so as to form filaments with side by side components.

6. The melt spinning apparatus as defined in claim 1 wherein said melt lines in said blending plate which extend to a common nozzle bore include one melt line which is coaxially aligned with the associated nozzle bore and another melt line which communicates with an annular ring surrounding the associated nozzle bore and which annular ring communicates with the associated nozzle bore via an annular slot, so as to form core-sheath filaments.

7. The melt spinning apparatus as defined in claim 1 wherein said melt lines in said blending plate each include a portion of narrowed cross section which provides a choking of the melt flow.

8. The melt spinning apparatus as defined in claim 1 further comprising block means positioned in said nozzle shaft so as to close its upper end, with said block means including a plurality of melt delivery lines therein and a connecting plug mounted at the lower end thereof, said spinning head means comprising a cup shaped member mounted to said connecting plug, said cup shaped member having a plurality of vertical bores therein and a bottom wall for each vertical bore, with each vertical bore communicating with one of said melt delivery lines and having at least one of said discharge outlet means in the associated bottom wall, and a filter assembly positioned in each of said vertical bores.

9. The melt spinning apparatus as defined in claim 8 wherein each filter assembly comprises a filter support plate mounted adjacent to said bottom wall of the associated bore and having at least one opening extending vertically therethrough, a filter pack supported on the upper side of said support plate, a piston mounted for limited axial movement in the upper portion of the associated bore so as to define a cavity between said filter support plate and said piston, and with said piston having an opening extending axially therethrough which communicates with said cavity and with the associated melt delivery line.

10. The melt spinning apparatus as defined in claim 9 wherein each nozzle assembly further comprises sealing ring means positioned in said cavity between said piston and said filter support plate for forming a seal between said piston and the walls of said bore, and so that said piston is biased upwardly against said connecting plug upon pressurized melt being received in said cavity, and gasket means for forming a seal between said piston and said connecting plug upon such upward biasing of said piston.

11. The melt spinning apparatus as defined in claim 1 wherein said plurality of parallel channels are formed in said blending plate.

12. The melt spinning apparatus as defined in claim 1 wherein said shaft of said heater box is tubular, and wherein said spinning nozzle plate, said blending plate, and said distributor plate are each of circular cross section and so as to be closely received in said tubular shaft.

13. A melt spinning apparatus adapted for spinning multi component yarn and comprising a heater box, spinning head means closely received in the heater box for extruding at least two different thermoplastic components through respective discharge outlet means, a collection chamber positioned below each of said discharge outlet means for receiving and collecting respective ones of said components, a spinning nozzle plate mounted below said collection chambers and including a plurality of nozzle bores extending vertically therethrough, a blending member mounted between said collection chambers and said nozzle plate, said blending member including a plurality of parallel longitudinal channels, and at least two melt lines leading to and communicating with each of said nozzle bores, with alternate ones of said channels respectively communicating with one of each of said two melt lines and intervening ones of said channels respectively communicating with a second one of each of said two melt lines, and distribution channel means connecting one of said collection chambers with selected ones of said parallel longitudinal channels and connecting a second one of said collection chambers with selected other ones of said parallel longitudinal channels, so that said melt lines leading to each nozzle bore are adapted to deliver different components to such nozzle bore, said distribution channel means including a plurality of melt ducts which terminate along a straight line which is perpendicular to the longitudinal direction of said channels.

* * * * *